United States Patent [19]

Berge et al.

[11] Patent Number: 4,899,549

[45] Date of Patent: Feb. 13, 1990

[54] TRANSPORT REFRIGERATION SYSTEM WITH IMPROVED TEMPERATURE AND HUMIDITY CONTROL

[75] Inventors: Jeffrey B. Berge, Bloomington; Jayaram Seshadri, Minneapolis; Jay L. Hanson, Bloomington, all of Minn.

[73] Assignee: Thermo King Corporation, Minneapolis, Minn.

[21] Appl. No.: 304,686

[22] Filed: Jan. 3, 1989

[51] Int. Cl.[4] ..... F25B 13/00

[52] U.S. Cl. ..... 62/160; 62/217; 236/75

[58] Field of Search ..... 62/217, 160, 324.6; 236/75, 78 C, 78 D

[56] References Cited

U.S. PATENT DOCUMENTS

| | | | |
|---|---|---|---|
| 2,191,102 | 2/1940 | Zerk et al. | 62/196.3 |
| 2,344,215 | 3/1944 | Soling et al. | 62/196.4 |
| 2,739,450 | 3/1956 | Breck | 62/196.1 |
| 2,881,597 | 4/1959 | Jacobs | 62/207 |
| 2,992,541 | 7/1961 | Sutton | 62/196.4 |
| 3,010,289 | 11/1961 | Kuklinski | 62/196.1 |
| 3,665,725 | 5/1972 | Barless et al. | 62/217 |
| 3,810,488 | 5/1974 | Orth et al. | 62/217 X |
| 3,973,618 | 8/1976 | Naley et al. | 62/223 |
| 4,325,224 | 4/1982 | Howland | 62/228 |
| 4,327,558 | 5/1982 | Howland et al. | 62/228.1 |
| 4,419,866 | 12/1983 | Howland | 62/228.4 |
| 4,556,942 | 12/1985 | Russo et al. | 62/135 X |
| 4,742,689 | 5/1988 | Lowes | 62/196.4 |
| 4,787,213 | 11/1988 | Gras et al. | 236/75 X |
| 4,787,214 | 11/1988 | Stillwell | 62/228.4 |
| 4,789,025 | 12/1988 | Brandemuehl et al. | 62/217 X |

*Primary Examiner*—William E. Wayner
*Attorney, Agent, or Firm*—D. R. Lackey

[57] ABSTRACT

A transport refrigeration system operable in cooling and heating cycles to maintain the temperature of a fresh load in a conditioned space extremely close to a predetermined set point temperature, with the cooling cycle primarily controlling the load temperature in ambients above freezing. The transport refrigeration system includes a compressor driven by a prime mover in one of two selectable speeds, an air delivery system which provides a substantially constant volume of conditioned air for a conditioned load space regardless of prime mover speed, a modulation valve in a suction line of the compressor, and a digital thermostat which senses the temperature of air returning to an evaporator. The digital thermostat controls the modulation valve via modulation control in a predetermined temperature range above and below set point, in both the heating and cooling cycles.

12 Claims, 11 Drawing Sheets

| | WORD # | (MSB) A | B | C | D | E | F | G | (LSB) H | ACTIVE RESISTORS | | | | | |
|---|---|---|---|---|---|---|---|---|---|---|---|---|---|---|---|
| TEMP. FALLING ↓ | 000 | 0 | 0 | 0 | 0 | 0 | 0 | 0 | 0 | | | | | | |
| LOW SPEED COOL (VALVE OPEN) | 110 | 0 | 1 | 1 | 0 | 1 | 1 | 1 | 0 | | | | | | LOW SPEED COOL (VALVE OPEN) |
| | 111 | 0 | 1 | 1 | 0 | 1 | 1 | 1 | 1 | | | | | | |
| LOW SPEED COOL MODULATION (VALVE CLOSING) | 112 | 0 | 1 | 1 | 1 | 0 | 0 | 0 | 0 | R9 | | | | | LOW SPEED COOL MODULATION (VALVE OPENING) |
| | 113 | 0 | 1 | 1 | 1 | 0 | 0 | 0 | 1 | R9 | | | | R5 | |
| | 114 | 0 | 1 | 1 | 1 | 0 | 0 | 1 | 0 | R9 | | | R6 | | |
| | 115 | 0 | 1 | 1 | 1 | 0 | 0 | 1 | 1 | R9 | | | R6 | R5 | |
| | 116 | 0 | 1 | 1 | 1 | 0 | 1 | 0 | 0 | R9 | | R7 | | | |
| | 117 | 0 | 1 | 1 | 1 | 0 | 1 | 0 | 1 | R9 | | R7 | | R5 | |
| | 118 | 0 | 1 | 1 | 1 | 0 | 1 | 1 | 0 | R9 | | R7 | R6 | | |
| | 119 | 0 | 1 | 1 | 1 | 0 | 1 | 1 | 1 | R9 | | R7 | R6 | R5 | |
| | 120 | 0 | 1 | 1 | 1 | 1 | 0 | 0 | 0 | R9 | R8 | | | | LOW SPEED HEAT MODULATION (VALVE CLOSING) |
| | 121 | 0 | 1 | 1 | 1 | 1 | 0 | 0 | 1 | R9 | R8 | | | R5 | |
| | 122 | 0 | 1 | 1 | 1 | 1 | 0 | 1 | 0 | R9 | R8 | | R6 | | |
| | 123 | 0 | 1 | 1 | 1 | 1 | 0 | 1 | 1 | R9 | R8 | | R6 | R5 | |
| | 124 | 0 | 1 | 1 | 1 | 1 | 1 | 0 | 0 | R9 | R8 | R7 | | | |
| | 125 | 0 | 1 | 1 | 1 | 1 | 1 | 0 | 1 | R9 | R8 | R7 | | R5 | |
| | 126 | 0 | 1 | 1 | 1 | 1 | 1 | 1 | 0 | R9 | R8 | R7 | R6 | | |
| | 127 | 0 | 1 | 1 | 1 | 1 | 1 | 1 | 1 | R9 | R8 | R7 | R6 | R5 | |
| SET POINT → | 128 | 1 | 0 | 0 | 0 | 0 | 0 | 0 | 0 | R9 | R8 | R7 | R6 | | |
| LOW SPEED HEAT MODULATION (VALVE OPENING) | 129 | 1 | 0 | 0 | 0 | 0 | 0 | 0 | 1 | R9 | R8 | R7 | R6 | | |
| | 130 | 1 | 0 | 0 | 0 | 0 | 0 | 1 | 0 | R9 | | R7 | | | |
| | 131 | 1 | 0 | 0 | 0 | 0 | 0 | 1 | 1 | R9 | | R7 | | | |
| | 132 | 1 | 0 | 0 | 0 | 0 | 1 | 0 | 0 | R9 | | | | | |
| | 133 | 1 | 0 | 0 | 0 | 0 | 1 | 0 | 1 | R9 | | | | | |
| | 134 | 1 | 0 | 0 | 0 | 0 | 1 | 1 | 0 | R9 | | | | | |
| | 135 | 1 | 0 | 0 | 0 | 0 | 1 | 1 | 1 | R9 | | | | | |
| LOW SPEED HEAT (VALVE OPEN) | 136 | 1 | 0 | 0 | 0 | 1 | 0 | 0 | 0 | | | | | | HIGH SPEED HEAT (VALVE OPEN) |
| | 137 | 1 | 0 | 0 | 0 | 1 | 0 | 0 | 1 | | | | | | |
| | 138 | 1 | 0 | 0 | 0 | 1 | 0 | 1 | 0 | | | | | | |
| | 139 | 1 | 0 | 0 | 0 | 1 | 0 | 1 | 1 | | | | | | |
| | 140 | 1 | 0 | 0 | 0 | 1 | 1 | 0 | 0 | | | | | | |
| | 141 | 1 | 0 | 0 | 0 | 1 | 1 | 0 | 1 | | | | | | |
| | 142 | 1 | 0 | 0 | 0 | 1 | 1 | 1 | 0 | | | | | | |
| | 143 | 1 | 0 | 0 | 0 | 1 | 1 | 1 | 1 | | | | | | |
| HIGH SPEED HEAT (VALVE OPEN) | 144 | 1 | 0 | 0 | 1 | 0 | 0 | 0 | 0 | | | | | | |
| | 256 | 1 | 1 | 1 | 1 | 1 | 1 | 1 | 1 | | | | | | ↑ TEMP. RISING |

FIG. 5

TRANSPORT REFRIGERATION SYSTEM WITH IMPROVED TEMPERATURE AND HUMIDITY CONTROL

TECHNICAL FIELD

The invention relates to transport refrigeration systems, and more specifically to transport refrigeration systems which provide conditioned air for fresh loads, such as farm produce and fresh cut flowers.

BACKGROUND ART

Transport refrigeration systems have been supplying conditioned air for fresh loads for many years, and the manufacturers of such systems have all been striving to accomplish the same goals. The goals are to maintain the temperature of the served space as close as possible to a selected set point temperature, with a uniformity which prevents damage to the load, and to maintain a high relative humidity in the served space.

Commercially available transport refrigeration systems usually maintain a desired set point temperature by continuously cycling between cooling and heating modes. Some systems include a null mode between the heating and cooling modes, during which a prime mover for the refrigerant compressor is shut down. Trailer refrigeration units commonly utilize a Diesel engine as a prime mover for operating a refrigerant compressor. Some trailer systems additionally have an electric stand-by motor for operating the compressor when the trailer is parked near a source of electric potential. Refrigerated containers or "reefers" commonly employ only an electric motor, with power being supplied from a Diesel engine driven electrical generator when the container is on a truck, and otherwise from electrical mains when the container is on board a ship or at a terminal.

A spring biased throttling valve is commonly placed in the suction line of the refrigerant compressor to protect the compressor and prime mover against overload when operating with high refrigerant pressure. The throttling valve reduces the thermal capacity of the system at times when an overload is not involved, however, and it is particularly inefficient in dual prime mover systems which may drive the compressor directly from a Diesel engine, or directly from an electric motor. The electric motor does not have as much power as the Diesel engine, and the spring of the throttling valve must be set to protect the electric motor, resulting in reduced thermal capacity when operating with the Diesel engine.

Diesel engine driven compressors of the prior art which operate continuously, as opposed to shutting down the Diesel engine when set point is reached, cycle continuously between cooling and heating modes to hold the desired set point temperature. The Diesel engine has ample driving power and is usually operated at high speed, such as about 2200 RPM, only during pull down, to rapidly bring the temperature of the served space to a predetermined temperature above set point, at which point the engine speed is reduced to a lower speed, such as 1400 RPM. The Diesel engine will then usually operate at the lower speed during the ensuing cycling back and forth between cooling and heating modes, reverting to high speed to hold set point only during cooling and heating modes associated with very high and very low ambient temperatures, respectively.

Thermal capacity, even with prior art systems which include compressor unloading, is such that with continuously operated compressors, the temperature difference between the entrance and exit air from the evaporator is relatively high, removing considerable moisture from the conditioned air via condensation on the evaporator coils. The significant thermal capacity of the prior art systems about set point also causes temperature swings which require maintaining the average temperature of the served space higher than optimum to prevent freezing of the load. Some container systems have utilized a controlled suction line modulation valve to gradually reduce thermal capacity during a cooling mode, to approach set point and then turn the electric motor off and enter a null mode as set point is reached.

The optimum average load temperature for fresh produce and cut flowers is as close to freezing as possible without damaging the load. Temperature swings which approach freezing and then are driven up during an ensuing heating cycle, result in an average load temperature several degrees above freezing. If the average load temperature could be maintained near freezing without damaging the load, and the relative humidity of the served space can be maintained at a high level, the shelf life of the produce or fresh cut flowers may be increased by as much as 100%, resulting in tremendous savings for the merchandiser

DISCLOSURE OF THE INVENTION

Briefly, the present invention is a transport refrigeration system having a compressor which may be driven by a Diesel engine, an electric motor, or in a dual drive system which includes both, without adversely affecting the thermal capacity of the system with either prime mover. The transport refrigeration system of the invention will closely hold a desired set point temperature without significant temperature swing, as the system will rarely go into a heating mode to hold set point with ambients above freezing.

More specifically, the invention is a transport refrigeration system which includes a modulation valve in the suction line of the refrigerant compressor which is controlled by a digital thermostat and modulation control when the load temperature is within a predetermined temperature band above and below set point, during both cooling and heating modes. The digital thermostat responds to a single temperature sensor disposed to sense the temperature of air returning to an evaporator from a served space. Air delivery means for drawing air from the served space for conditioning by the evaporator provides a constant flow of conditioned air for the served space, regardless of prime mover speed.

The refrigerant compressor is driven continuously by the prime mover, i.e., the prime mover is not shut down, with the prime mover preferably including at least a Diesel engine having two selectable speeds, referred to as high and low speeds. During temperature pull down, high speed is selected which cools the conditioned air in a high speed cooling mode until the air returning to the evaporator from the served space reaches a first predetermined temperature differential relative to the selected temperature set point, at which time the low speed is selected. The temperature of the served space continues to be reduced towards set point in a low speed cooling mode until the return air temperature has a second predetermined differential relative to set point. At this time, a controllable, normally open, modulation valve in the suction line is controlled by modulation control responsive to a digital signal from the digital thermostat. The modulation valve is controlled to gradually close as the temperature is reduced towards set point, fully closing as set point is reached. A bleed port in the modulation valve continues to provide some thermal capacity at a very light load on the compressor and prime mover, such that with normal ambients the system remains in a low speed cooling mode while holding set point with no significant temperature swing. Thus, there is very little temperature drop across the evaporator, and very little moisture condenses on the evaporator coils, maintaining a high relative humidity with a aspirating load.

If the temperature of the return air should tend to drop, such as with a low outside ambient, the system will switch to a hot gas heating mode, in which hot compressor discharge gas is diverted from a condenser to the evaporator. The modulation control of the compressor suction line continues, gradually opening the modulation valve in response to the magnitude of the difference between the return air temperature and set point. Thus, there is no sudden upward change or swing in temperature, resulting in the temperature of the served space normally remaining close to set point. If the temperature of the return air should start to rise above set point, such as with high outside ambients, the modulation control will gradually open the modulation valve in direct response to the temperature differential between the return air and set point. When the return air temperature starts to drop, the modulation valve will again be controlled to gradually close.

Instead of utilizing a throttling valve which responds to refrigerant pressure to protect against compressor overload and/or prime mover overload, the present invention eliminates the need for a throttling valve and detects overload directly. A sensor is disposed to provide a signal from the Diesel engine and/or electric motor which indicates a high-load condition, and the modulation valve is controlled to throttle the suction pressure. The sensor may sense engine oil temperature, engine coolant temperature, engine exhaust temperature, motor winding temperature, motor current, and the like. By sensing different levels of overload, the modulation valve may be set to close according to the amount of refrigeration system unloading required.

BRIEF DESCRIPTION OF THE DRAWINGS

The invention will become more apparent by reading the following detailed description in conjunction with the drawings, which are shown by way of example only, wherein:

FIG. 5 is a digital algorithm implemented by the modulation control shown in FIG. 4, setting forth combinations of parallel connected resistors which are connected to an electrical control coil of the modulation valve to provide the desired coil current and valve position at different temperature differentials relative to set point;

DESCRIPTION OF PREFERRED EMBODIMENTS

Certain of the refrigeration control utilized may be conventional, and is shown in U.S. Pat. Nos. 4,712,383; 4,419,866; and 4,325,224, for example. These patents are hereby incorporated into the specification of the present application by reference.

Figure 1:
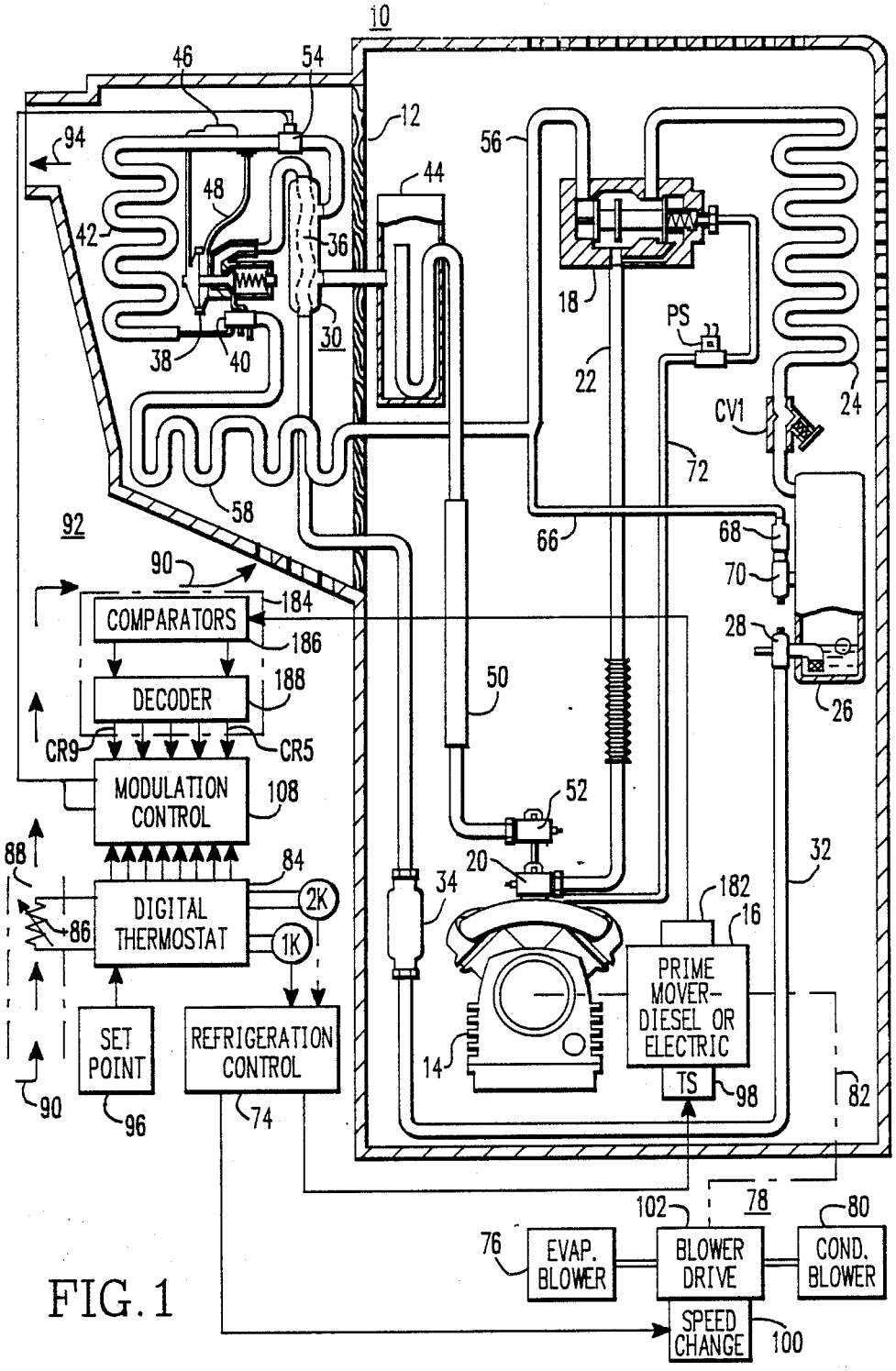
FIG. 1 is a partially schematic and partially block diagram of a transport refrigeration system constructed according to the teachings of the invention.

Referring now to the drawings, and to FIG. 1 in particular, there is shown a transport refrigeration system 10 constructed according to the teachings of the invention. Refrigeration system 10 is mounted on the front wall 12 of a truck or trailer. Refrigeration system 10 includes a closed fluid refrigerant circuit which includes a refrigerant compressor 14 driven by a prime mover, such as an internal combustion engine, e.g., a Diesel engine, and/or an electric motor, indicated generally at 16. Discharge ports of compressor 14 are connected to an inlet port of a three-way valve 18 via a discharge service valve 20 and a hot gas conduit or line 22. The functions of the three-way valve 18, which has heating and cooling positions, may be provided by separate valves, if desired.

One of the output ports of three-way valve 18 is connected to the inlet side of a condenser coil 24. This port is used as a cooling position of three-way valve 18, and it connects compressor 14 in a first refrigerant circuit. The outlet said of condenser coil 24 is connected to the inlet side of a receiver tank 26 via a one-way condenser check valve CVI which enables fluid flow only from the outlet side of condenser coil 24 to the inlet side of receiver tank 26. An outlet valve 28 on the outlet side of receiver tank 26 is connected to a heat exchanger 30 via a liquid conduit or line 32 which includes a dehydrator 34.

Liquid refrigerant from liquid line 32 continues through a coil 36 in heat exchanger 30 to an expansion valve 38. The outlet of expansion valve 38 is connected to a distributor 40 which distributes refrigerant to inlets on the inlet side of an evaporator coil 42. The outlet side of evaporator coil 42 is connected to the inlet side of a closed accumulator tank 44 via a controllable suction line modulation valve 54 and heat exchanger 30. Expansion valve 38 is controlled by an expansion valve thermal bulb 46 and an equalizer line 48. Gaseous refrigerant in accumulator tank 44 is directed from the outlet side thereof to the suction port of compressor 14 via a suction line 50, and a suction line service valve 52. The modulation valve 54 is located in a portion of suction line 50 which is adjacent the outlet of evaporator 42 and prior to heat exchanger 30 and accumulator 44 in order to protect compressor 14 by utilizing the volumes of these devices to accommodate any liquid refrigerant surges which may occur while modulation valve 54 is being controlled.

In the heating position of three-way valve 18, a hot gas line 56 extends from a second outlet port of three-way valve 18 to the inlet side of evaporator coil 42 via a defrost pan heater 58 located below evaporator coil 42. A by-pass conduit or pressurizing tap 66, extends from hot gas line 56 to receiver tank 26 via by-pass and service check valves 68 and 70, respectively.

A conduit 72 connects three-way valve 18 to the intake side of compressor 14 via a normally closed pilot solenoid valve PS. When solenoid operated valve PS is closed, three-way valve 18 is spring biased to the cooling position, to direct hot, high pressure gas from compressor 14 to condenser coil 24. A bleed hole in the valve housing allows pressure from compressor 14 to exert additional force to help maintain valve 18 in the cooling position. Condenser coil 24 removes heat from the gas and condenses the gas to a lower pressure liquid. When evaporator 42 requires defrosting, and also when a heating mode is required to hold the thermostat set point of the load being conditioned, pilot solenoid valve PS is opened via voltage provided by a refrigeration control function 74. Three-way valve 18 is then operated to its heating position, in which flow of refrigerant in the form of hot gas to condenser 24 is sealed and flow to evaporator 42 is enabled. Suitable control 74 for operating solenoid valve PS is shown in the incorporated patents.

The heating position of three-way valve 18 diverts the hot high pressure discharge gas from compressor 14 from the first or cooling mode refrigerant circuit into a second or heating mode refrigerant circuit which includes distributor 40, defrost pan heater 58, and the evaporator coil 42. Expansion valve 38 is by-passed during the heating mode. If the heating mode is a defrost cycle, an evaporator fan or blower 76 is not operated. During a heating cycle required to hold a thermostat set point temperature, the evaporator blower 76 is operated. Evaporator blower 76 is part of air delivery means 78, which also includes a condenser fan or blower 80. Air delivery means 78 may be belt driven from prime mover 16, for example, as indicated by broken line 82.

Refrigeration control 74 includes a digital thermostat 84 having a temperature sensor 86 disposed in a return air path 88 in which return air, indicated by arrows 90, is drawn from a served space 92 through return air path 88. The return air 90 is then conditioned by passing over evaporator 42, and it is then discharged back into the served space 92, by evaporator blower 76, with the conditioned air being indicated by arrow 94. The digital thermostat 84 includes set point selector means 96 for selecting the desired set point temperature to which system 10 will control the temperature of the return air 90.

A digital thermostat which may be used is disclosed in co-pending applications Ser. Nos. 020,259 now U.S. Pat. No. 4,819,441 and 236,878 filed Feb. 27, 1988 and Aug. 26, 1988, respectively, both entitled "Temperature Controller For A Transport Refrigeration System", and both assigned to the same assignee as the present application. These applications are hereby incorporated into the specification of the present application by reference. Application Ser. No. 020,259 is now U.S. Pat. No. 4,819,441.

Signals provided by digital thermostat 84 control heat and speed relays 1K and 2K, respectively, which have contacts in refrigeration control 74, as illustrated in the incorporated patents. Heat relay 1K is de-energized when system 10 should be in a cooling mode, and it is energized when system 10 should be in a heating mode. Speed relay 2K is de-energized when system 10 should be operating prime mover 16 at low speed, e.g., 1400 RPM, and it is energized when prime mover 16 should be operating at high speed, e.g., 2200 RPM. The different basic operational cooling and heating modes of system 10 are set forth in the chart of FIG. 2, with the conditions of relays 1K and 2K being indicated along the sides of the chart. An upwardly pointing arrow indicates the associated relay is energized, and a downwardly pointing arrow indicates the associated relay is de-energized. Operation with a falling temperature of the return air 90 is indicated along the left hand side of the diagram, starting at the top, and operation with a rising temperature of the return air 90 is indicated along the right hand side, starting at the bottom. Contacts of the heat relay 1K, for example, are connected in refrigeration control 74 to de-energize and energize the pilot solenoid valve PS, to select cooling and heating modes, respectively. Contacts of the speed relay 2K, for example, are connected in refrigeration control 74 to de-energize and energize a throttle solenoid 98 associated with prime mover 16, for selecting low and high speeds, respectively. Contacts of speed relay 2K may also be connected to provide a signal for a speed change unit 100 associated with a blower drive arrangement 102 of the air delivery means 78. Blower drive arrangement 102 and speed change unit 100 are arranged to provide a substantially constant volume of conditioned air 94 for served space 92, regardless of the speed of prime mover 16. In other words, when the prime mover 16 is changed from high to low speed, the speed change unit 100 is actuated to cause the evaporator blower 76 to remain at substantially the same RPM. A blower drive arrangement with a speed change unit which may be used for functions 100 and 102 is disclosed in Application Ser. No. 270,861, filed Nov. 14, 1988 entitled "Air Delivery System For A Transport Refrigeration Unit", which is assigned to the same assignee as the present application.

Figure 3:
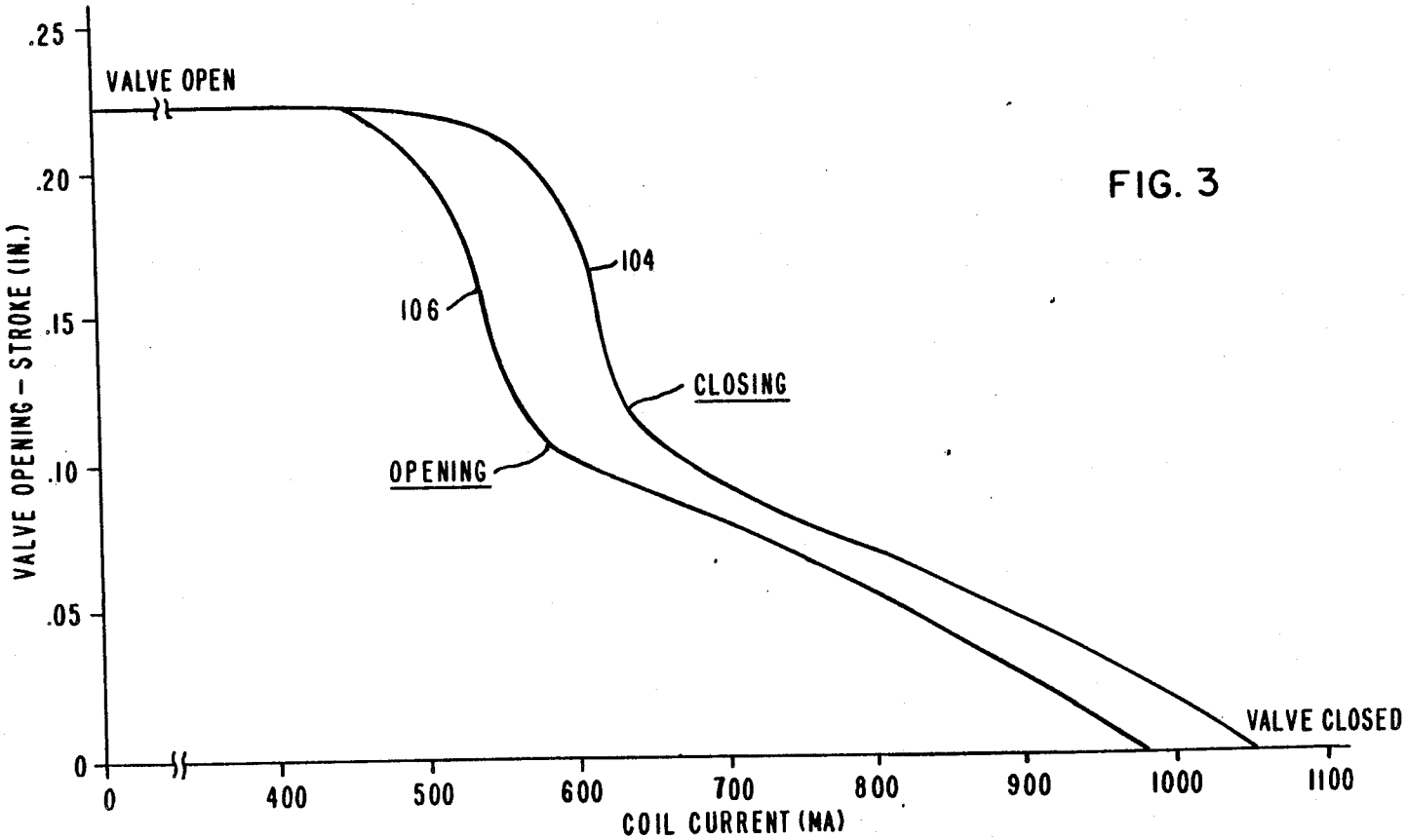
FIG. 3 is a graph plotting valve opening versus coil current for a controllable modulation valve which may be used in the transport refrigeration system shown in FIG. 1.

Modulation valve 54 may have an exemplary characteristic such as set forth in the graph of FIG. 3, which plots valve opening or stroke in inches versus control coil current. With no current flowing in a control coil of modulation valve 54, valve 54 is open. Increasing the coil current from zero provides a valve closing characteristic indicated by curve 104, fully closing valve 54 with a current of about 1000 milliamperes (ma). Decreasing the coil current opens valve 54, following an opening characteristic curve 106. Of course, modulation valves having other opening and closing characteristics may be used.

Digital thermostat 84 provides an 8-bit digital signal having a magnitude responsive to the difference between the temperature sensed by temperature sensor 86, i.e., the temperature of the return air 90, and the set point temperature selected by set point selector 96. This digital signal from thermostat 84 is translated to the desired valve control current by modulation control 108, which is shown in block form in FIG. 1 and in a detailed schematic diagram in FIG. 4.

Figure 4:
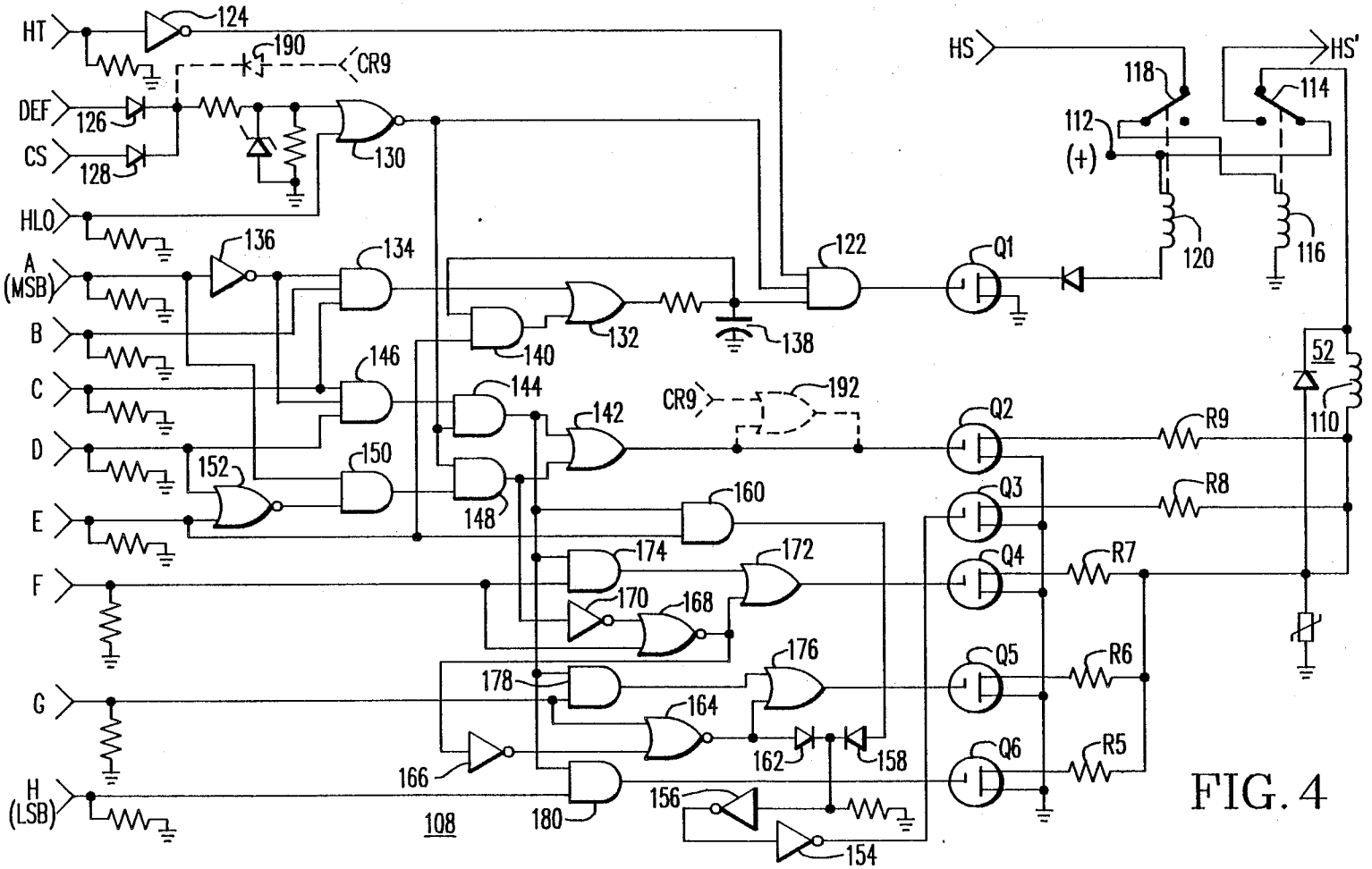
FIG. 4 is a detailed schematic diagram of modulation control which may be used for the modulation control function shown in block form in FIG. 1.

As shown in FIG. 4, modulation valve 52 includes a control coil 110 connected to a source 112 of unidirectional potential via normally closed contacts 114 of a high speed relay 116. High speed relay 116 is connected to be energized by a true signal HS provided by thermostat 84, via normally closed contacts 118 of a modulation control, low speed cool relay 120. Relay 120 is connected between source 112 and ground via a solid state switch Q1. Thus, when thermostat 84 indicates system 10 should be in a high speed mode, signal HS will go high and energize relay 116 if the system 10 is not currently in a low speed cool modulating mode. When high speed relay 116 picks up, modulation coil 110 cannot be energized, and modulation valve 52 will be wide open.

When high speed operation is not being called for, and system 10 is in a low speed cool modulation mode, switch Q1 will be closed, relay 120 will be energized, and high speed relay 116 cannot be energized. Thus, coil 110 will be enabled, by virtue of being connected to source 112. If system 10 is in a low speed heat modulation mode, relay 120 will be de-energized, and if the high speed signal HS goes true, contacts 114 will open to remove power from coil 110.

Solid state switch Q1 is controlled by an AND gate 122 which has an input connected to receive a signal HT from thermostat 84 via an inverter gate 124. Signal HT is high when thermostat 84 indicates system 10 should be in a heating mode, and low when thermostat 84 indicates system 10 should be in a cooling mode. Thus, if signal HT is high, indicating a heating mode, solid state switch Q1 cannot turn on to energize the low speed cool modulation relay Q1.

AND gate 122 also has an input responsive to signals DEF, CS and HLO provided by thermostat 84, via diodes 126 and 128 and a NOR gate 130. Signal DEF is true when system 10 is in a defrost mode; signal CS goes true when system 10 is manually switched from a continuous run mode to a start-stop mode. In the start-stop mode prime mover 16 is shut down when the system is satisfied, to go into a null mode; and signal HLO is true when the set point temperature selected by selector 96 is below a predetermined heat lock out temperature, indicating the system 10 is providing conditioning for a frozen load. If any of these signals are true, NOR gate 130 will output a logic zero, AND gate 122 cannot output a logic one, and solid state switch Q1 will be off. As will be hereinafter described, NOR gate 130 also provides an enable signal for the remaining portion of the suction line modulation control, enabling suction line modulation when it outputs a logic one, and disabling suction line modulation when a logic zero.

AND gate 122 also has an input responsive to the three most significant bits A, B, and C of the digital signal from thermostat 84, via an OR gate 132, an AND gate 134, and an inverter gate 136. As shown in the digital algorithm of FIG. 5, the most significant bit A will be a logic zero when the sensed temperature is above set point, and a logic one at and below set point. Bits B and C will also be a logic one starting at word number 96 until set point is reached. Word number 96 appears at a temperature differential of +6.8 degrees F. (+3.77 degrees C.), the start of the low speed full cool mode shown in FIG. 2. Thus, AND gate 122 will be enabled from the start of low speed cool until the temperature of the return air 90 reaches set point. Once bits A, B and C have enabled AND gate 122, a capacitor 138 will be charged and provide an input for an AND gate 140. A remaining input to AND gate 140 is responsive to bit E from digital thermostat 84. This maintains system 10 in a low speed cooling mode should the return air 90 start to increase in temperature before set point is reached. The words 120 through 127 during which bit E is true cover a temperature range which is in a low speed heat modulation mode once the temperature has been reduced below set point and then starts to rise. Since capacitor 138 will not be charged in this situation, the system will stay in the low speed heat modulation mode when the temperature of air 90 rises above set point, until word 119 is reached, as shown in FIG. 5.

Figure 2:
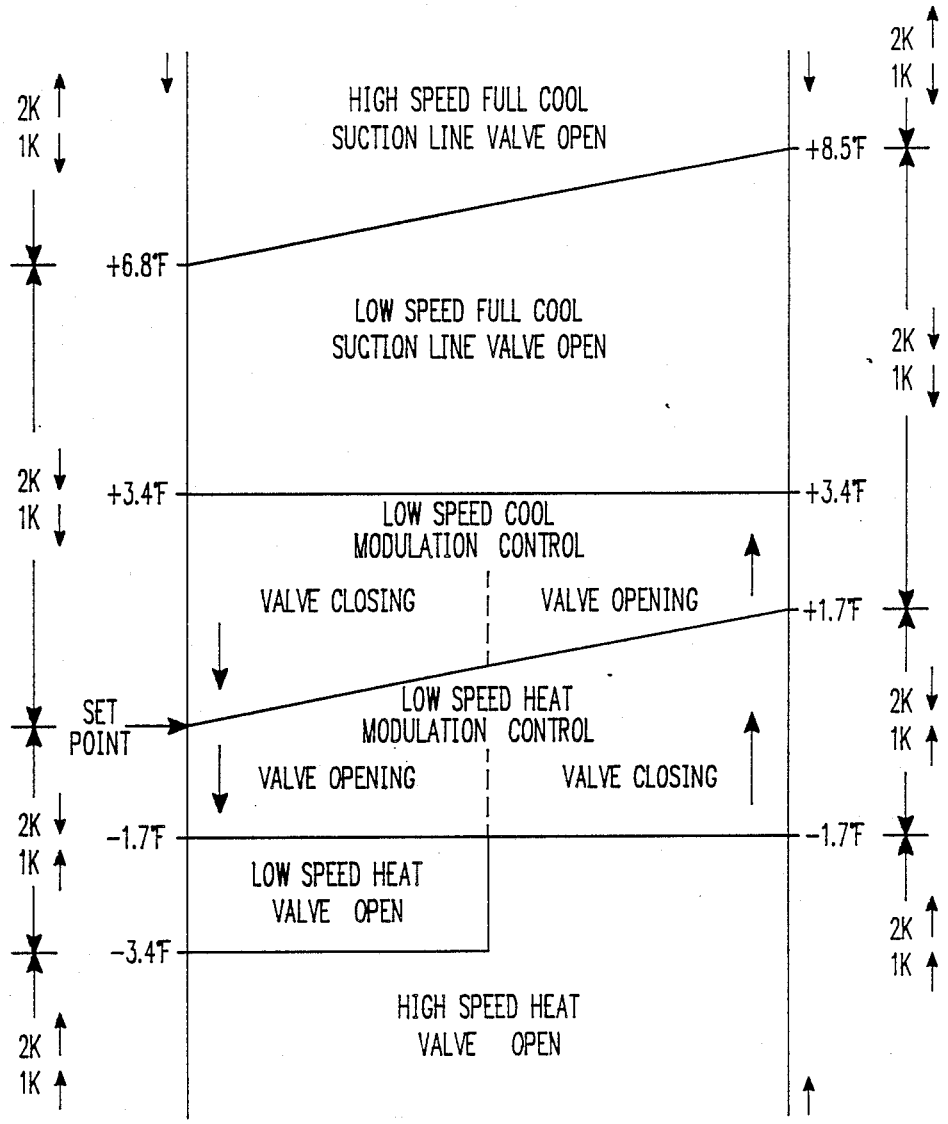
FIG. 2 is a diagram which sets forth basic cooling and heating modes implemented by a digital thermostat and refrigeration and modulation control of the transport refrigeration system of FIG. 1.

Modulation control 108 controls the magnitude of the electrical current flowing in coil 110 during the modulating modes shown in FIGS. 2 and 5, by controlling the magnitude of the resistance between coil 110 and ground. Resistors R9, R8, R7, R6 and R5 are connected in parallel with one another between coil 110 and ground via solid state switches Q2, Q3, Q4, Q5 and Q6, respectively. In the following discussion concerning which resistors are connected between coil 110 and ground it will be assumed that modulation is enabled by a high output from NOR gate 130.

Above set point, resistor R9 is connected between coil 110 and ground during digital words 112 through 127 in response to bit A cf the digital thermostat signal being a logic zero, and bits C and D of the digital thermostat signal being logic ones, via solid state switch Q2, OR gate 142, AND gates 144 and 146, and inverter gate 136. At set point and below, resistor R9 is connected between coil 110 and ground during words 128 through 135 in response to bit A being a logic one, and bits D and E being logic zeros, via OR gate 142, AND gates 148 and 150, and a NOR gate 152.

Above set point, resistor R8 is connected between coil 110 and ground during words 120 through 127 in response to bit A being a logic zero and bits C, D and E being logic ones, via solid state switch Q3, inverter gates 154 and 156, diode 158, AND gates 160, 144 and 146, and inverter gate 136. At set point and below, resistor R8 is connected between coil 110 and ground during words 128 and 129 in response to bit A being a logic one, and bits D, E, F and G being logic zeros, via inverter gates 154 and 156, diode 162, NOR gate 164, inverter gate 166, NOR gate 168, inverter gate 170,, AND gates 148 and 150, and NOR gate 152.

Above set point, resistor R7 is connected between coil 110 and ground during words 116 through 119 and words 124 through 127 in response to bit A being a logic zero and bits C, D and F being logic ones, via solid state switch Q4, OR gate 172, AND gates 174, 144, and 146, and inverter gate 136. At set point and below, resistor R7 is connected between coil 110 and ground during words 128 through 131 in response to bit A being a logic one and bits D, E and F being logic zeros, via solid state switch Q4, OR gate 172, NOR gate 168, inverter gate 170, AND gates 148 and 150, and NOR gate 152.

Above set point, resistor R6 is connected between coil 110 and ground during words 114, 115, 118, 119, 122, 123, 126 and 127 in response to bit A being a logic zero and bits C, D and G being logic ones, via solid state switch Q5, OR gate 176, AND gates 178, 144 and 146, and inverter gate 136. At set point and below, resistor R6 is connected between coil 110 and ground during words 128 and 129 in response to bit A being a logic one and bits D, E, F and G being logic zeros, via solid state switch Q5, OR gate 176, NOR gate 164, inverter gate 166, NOR gate 168, inverter gate 170, AND gates 148 and 150, and NOR gate 152.

Resistor R5 is only connected to coil 110 above set point, at words 113, 115, 117, 119, 121, 123, 125 and 127, in response to bit A being a logic zero and bits C, D and H being logic ones, via solid state switch Q6, AND gates 180, 144 and 146, and inverter gate 136.

In addition to accurately holding set point with little temperature swing, modulation valve 54 may be used to restrict thermal capacity in response to an actual overload condition, unlike prior art suction throttling valves which may restrict thermal capacity when there is no actual overload, and which must be set in a compromise position when Diesel and electric drives may be alternatively connected to drive compressor 14. A sensor 182 shown in FIG. 1 may be disposed to provide a signal in response to a predetermined engine or motor overload condition, or multiple sensors may be used to detect both engine and motor overloads, depending upon which drive is functional. The signal provided by sensor 182 may be applied to an overlaad detecting function 184. Function 184, for example, may include one or more comparators, depending upon how many stages of overload are to be detected, with the outputs of the comparators being decoded by a decoder or matrix 188 to provide a digital signal which selects predetermined resistors R9 through R6 for connection between coil 110 and ground, to close valve 54 to a predetermined position corresponding to the level of overload detected. If two levels of overload are to be detected, for example, the outputs of the comparators may be decoded according to Table I to provide predetermined valve positions during overload.

TABLE I

| | DECODER OUTPUT | | | | |
|---|---|---|---|---|---|
| DECODER INPUT | CR9 | CR8 | CR7 | CR6 | CR5 |
| 0 0 | 0 | 0 | 0 | 0 | 0 |
| 0 1 | 1 | 1 | 0 | 0 | 0 |
| 1 1 | 1 | 1 | 1 | 1 | 1 |

With neither comparator detecting an overload, the overload function would not be controlling, and the decoder output would be all logic zeros. With one comparator detecting a first stage of overload, resistors R9 and R8, for example, may be connected in parallel between coil 110 and ground via true control signals CR9 and CR8, to partially close valve 54. With both comparators detecting an overload, all resistors R5 through R9, for example, may be connected in parallel between coil 110 and ground, to close valve 54.

Exemplary connections of control signals CR9 through CR5 to the modulation control 108 are shown in phantom in FIG. 4. Control signal CR9 may be connected to NOR gate 130 via a diode 190, to block normal suction line modulation during an overload condition. Each of the control signals CR9 through CR5 may be connected to solid state switches Q2 through Q6, respectively, through appropriate OR gates. For example, an OR gate 192 may be provided between OR gate 142 and solid state switch Q2, with the output of OR gate 142 being connected to one input of OR gate 192 and overload control signal CR9 being connected to the other input of OR gate 192. The remaining overload signals CR8 through CR5 may be connected to the remaining solid state switches Q2 through Q6, respectively, in like manner.

In the operation of transport refrigeration system 10, as illustrated in the diagram of FIG. 2, during initial pull down, the system would operate in a high speed cooling mode during which valve 54 would be Wide open. When the temperature of the return air 90 reaches a predetermined differential above set point, such as +6.8 degrees F. (+3.77 degrees C.), for example, system 10 switches to low speed cool. The modulation valve 54 remains open during this mode, and as the speed of the prime mover 16 is dropped, the air delivery means 78 is operated to maintain the evaporator blower 76 at substantially the same speed. Upon nearing set point, such as at a temperature differential of +3.4 degrees F. (+1.89 degrees C.), for example, system 10 switches to low speed cool with modulation control. Each bit change of the signal from digital thermostat 84 then starts to add resistance combinations between coil 110 and ground which gradually increases the coil current and gradually closes modulation valve 54, until reaching digital word 127 just above set point, at which point the coil current is maximum and modulation valve 54 is closed, except for a bleed port which continues to provide some thermal capacity. With outside ambients above freezing, the temperature of the return air 90 may be maintained near set point with the thermal capacity provided by the bleed port, and system 10 will operate with little load and thus little fuel or electrical power consumption, without going into a heating cycle.

If the temperature of the return air should drop to set point or below, the system 10 will switch to a low speed heating mode, with modulation, in which valve 54 will be controlled to gradually open, depending upon the deviation of the return air 90 below set point. In severe ambients, system 10 will switch out of low speed heat with modulation to low speed heat without modulation, with valve 54 completely open, such as at a differential of 1.7 degrees F. (−0.94 degrees C.), and to a high speed heating mode, with valve 54 completely open, such as at a differential of −3.4 degrees F. (−1.89 degrees C.).

With a rising temperature, starting with system 10 in a high speed heating mode, the system will switch to a low speed heating mode with modulation at a predetermined temperature differential, such as −1.7 degrees F. (−0.94 degrees C.), during which valve 54 will progressively close as set point is approached. If the temperature should continue to rise above set point, system 10 will remain in low speed heat with modulation until reaching a differential above set point, such as +1.7 degrees F. (+0.94 degrees C.), switching at this point to low speed cool with modulation, at which point valve 54 will start to open if the differential increases. At a differential of +3.4 degrees F. (+1.89 degrees C.) with an increasing return air temperature, system 10 will switch to low speed cool, with valve 54 completely open, and with a continued rise in temperature of the return air 90, such as at a differential of +8.5 degrees F. (+4.7 degrees C.), system 10 will switch to high speed cool.

Figure 6:
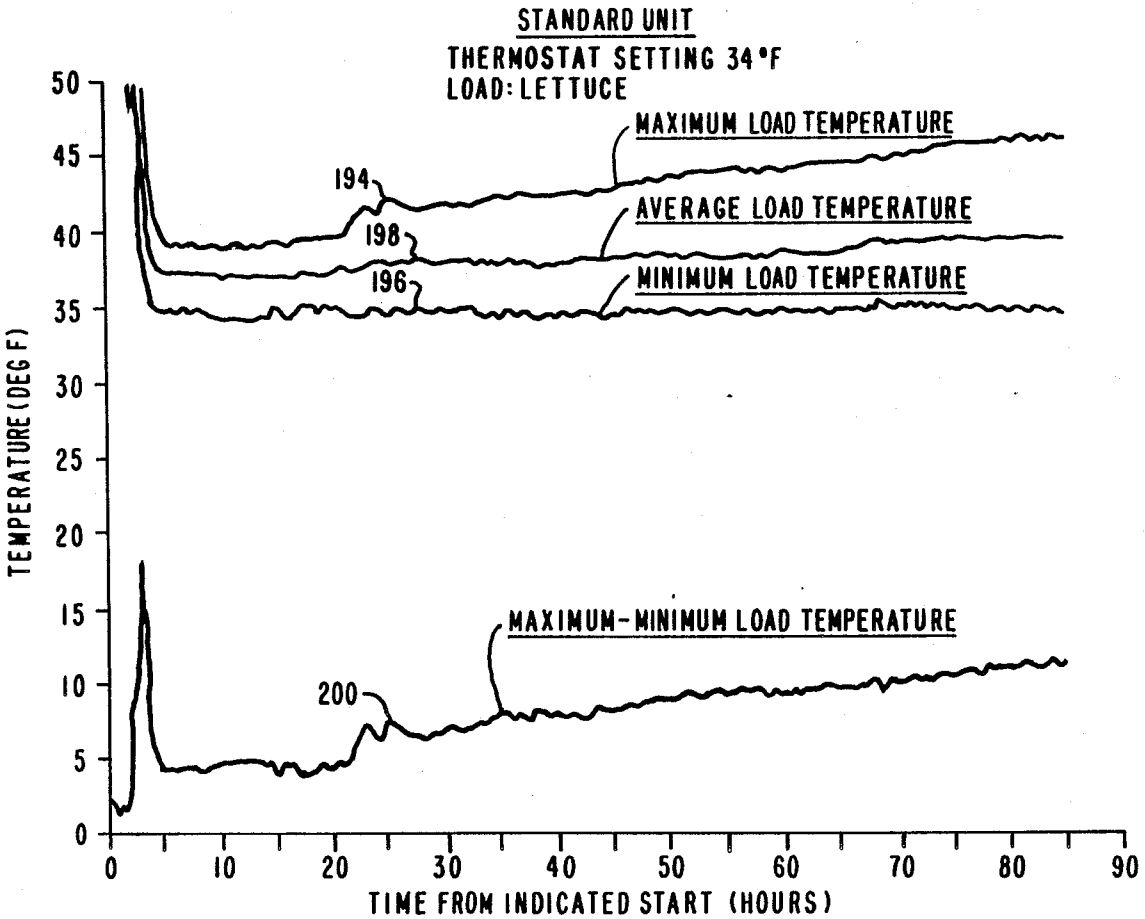
FIG. 6 is temperature versus time chart setting forth certain important temperature measurements of a load of lettuce controlled by a prior art transport refrigeration unit.

The improvements in both temperature and humidity control over state of the art prior art systems are significant, as evidenced by actual comparison tests which will be hereinafter described. FIG. 6 is a graph which plots temperature versus time for a standard transport refrigeration system, which controlled a load of lettuce to a set point selection of 34 degrees F. (1.11 degrees C.). The standard transport refrigeration system operated by sensing return air, without compressor unloading and without constant air. Thermocouples were placed throughout the load to determine maximum and minimum load temperatures. The test was conducted over a period of 85 hours. Curve 194 indicates the maximum load temperature, curve 196 indicates minimum load temperature, curve 198 indicates average load temperature, and curve 200 indicates the differential between maximum and minimum load temperatures.

Figure 7:
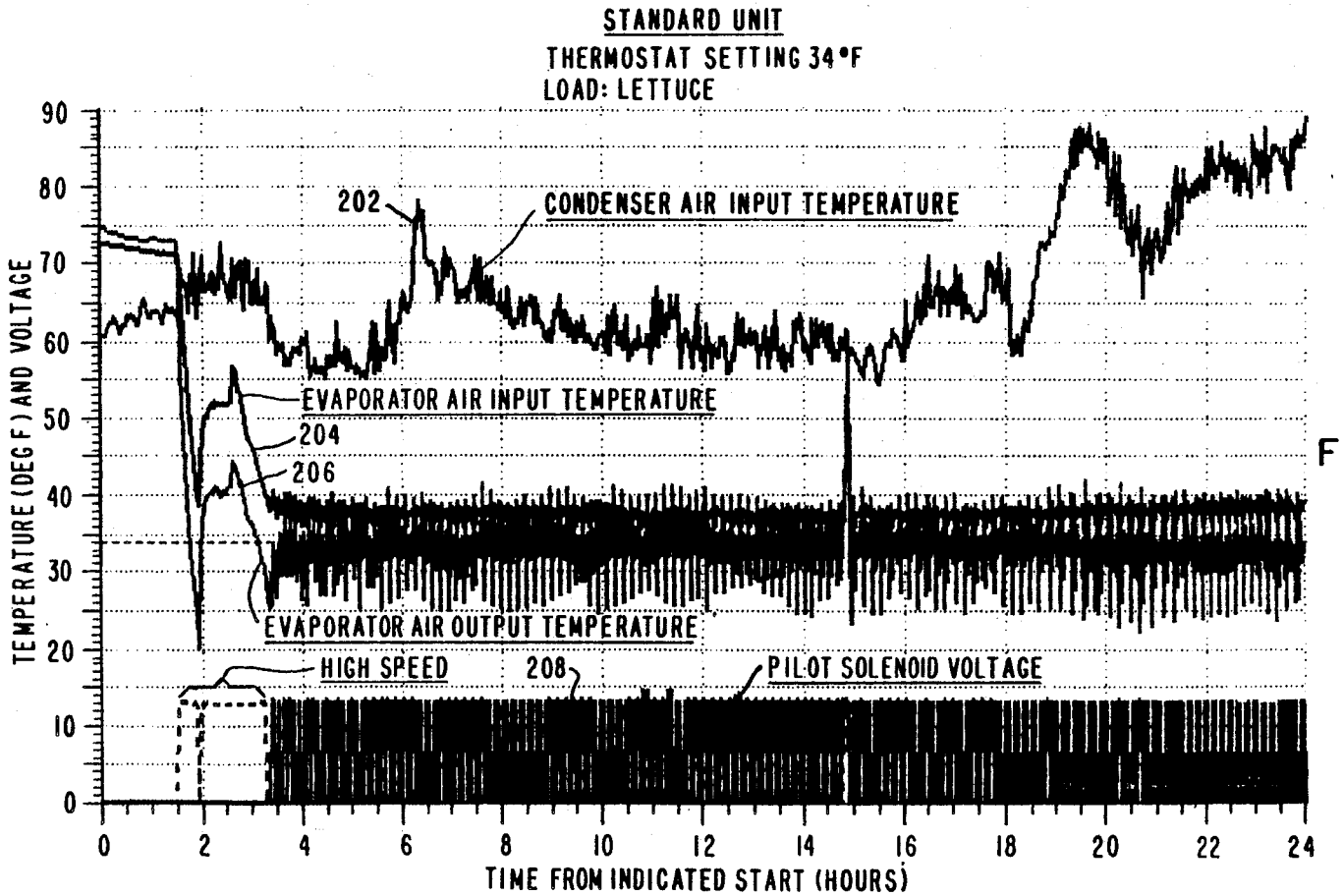
FIG. 7 is a temperature and voltage versus time chart illustrating additional important parameters associated with the prior art transport refrigeration unit test of FIG. 6.

FIG. 7 is a chart which sets forth additional readings taken relative to the test documented in FIG. 6. The readings of FIG. 7 cover a range of the first 24 hours of the test shown in FIG. 6. The readings of FIG. 7 are not shown for the remaining period of the test because, other than the condenser air input temperature, which varied with ambient, the remaining readings were substantially the same. Curve 202 indicates the condenser air input temperature, curve 204 the evaporator air input temperature, curve 206 the evaporator air output temperature, and curve 208 the voltage applied to pilot solenoid PS. When the pilot solenoid PS has voltage applied thereto, it indicates a heating cycle, and it will be noted that set point is held by constantly switching between cooling and heating cycles, which causes the evaporator air output temperature (curve 206) to swing from a low of about 25 degrees F. (−3.89 degrees C.) to a high of about 38 degrees F. (3.33 degrees C.).

Figure 8:
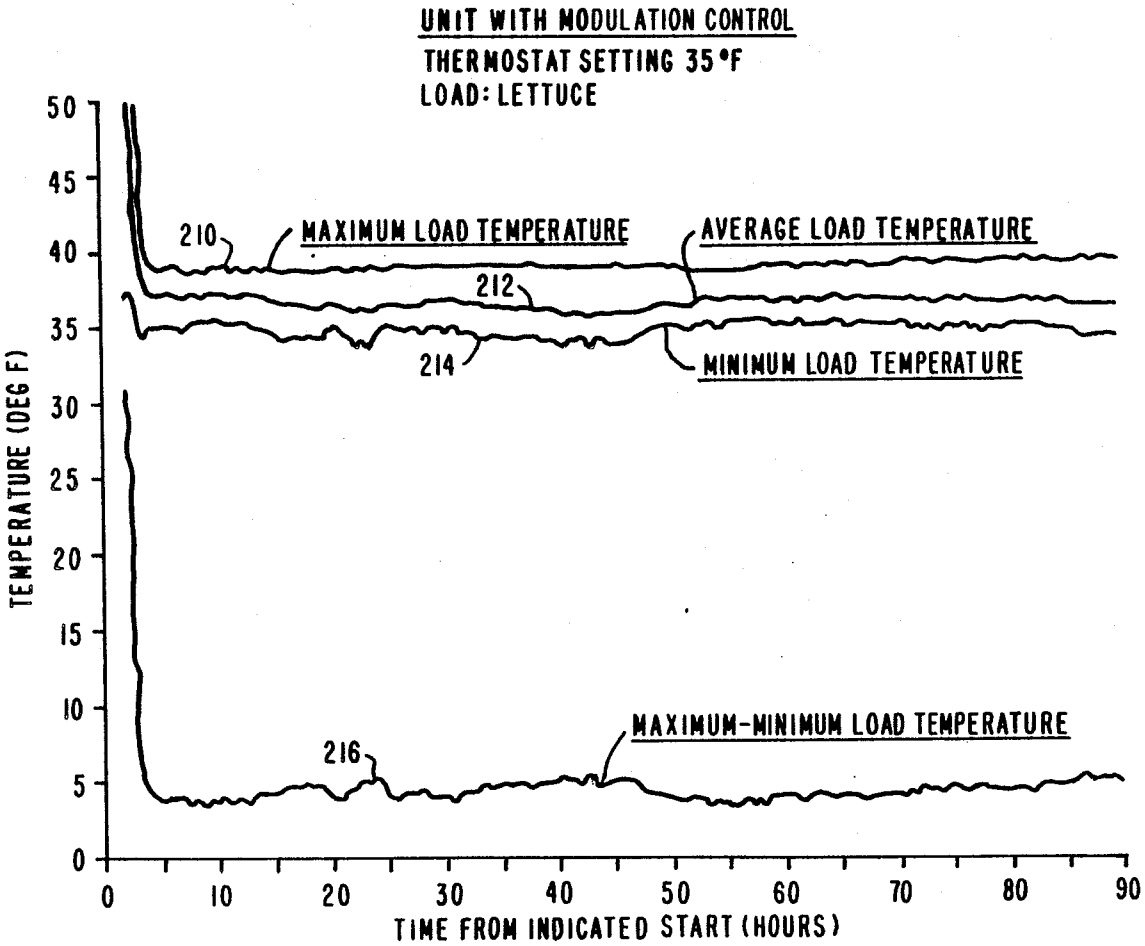
FIG. 8 is a temperature versus time chart similar to that of FIG. 6, except for a load of lettuce controlled by a transport refrigeration system constructed according to the teachings of the invention.

FIG. 8 is a graph similar to the graph of FIG. 6, except recording tests conducted on a load of lettuce using a transport refrigeration system constructed according to the teachings of the invention, with set point at 35 degrees F. (1.67 degrees C.). Curve 210 indicates maximum load temperature, curve 212 the average load temperature, curve 214 the minimum load temperature, and curve 216 the differential between maximum and minimum load temperatures.

Figure 9:
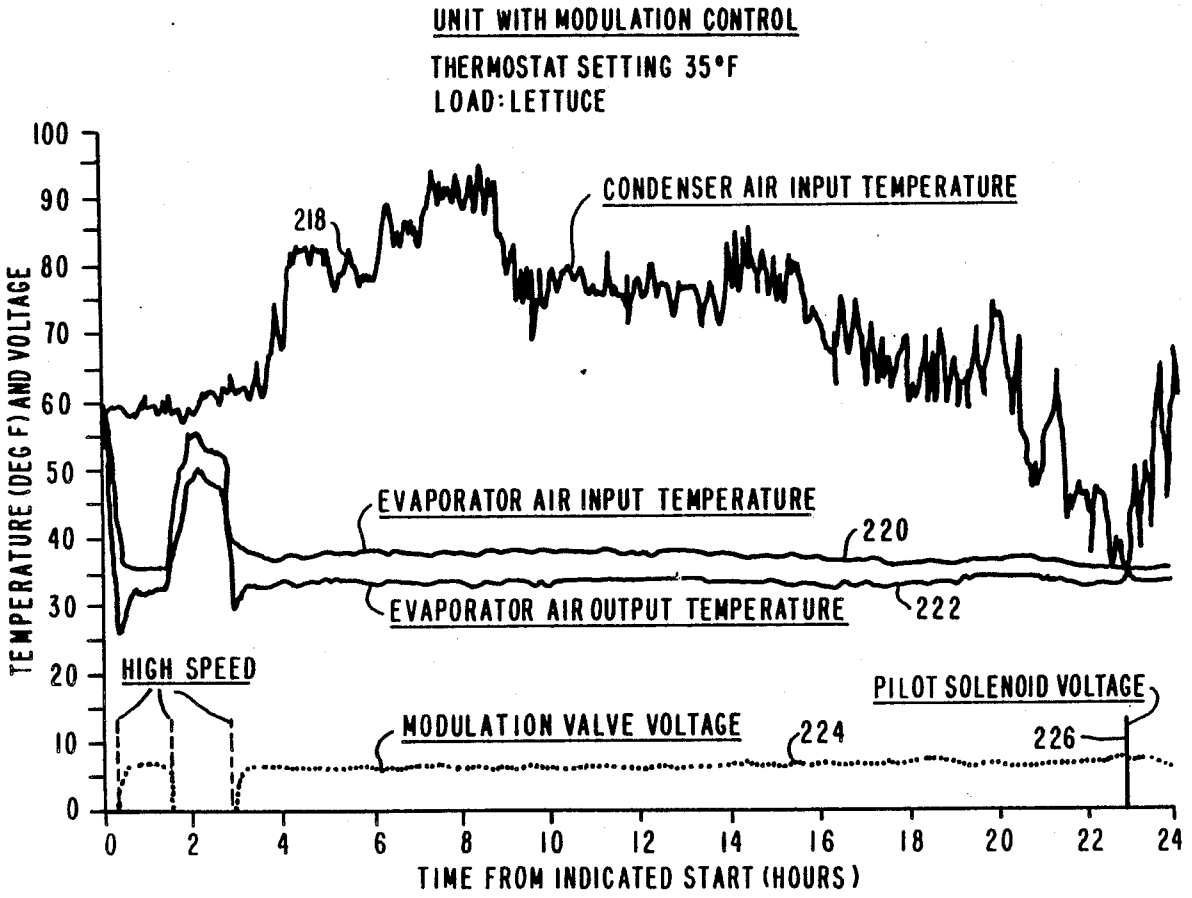
FIG. 9 is a temperature and voltage versus time chart similar to that of FIG. 7, except illustrating additional parameters associated with the test documented in FIG. 8 which used a transport refrigeration system constructed according to the teachings of the invention.

FIG. 9 is a graph similar to the graph of FIG. 7, except setting forth additional readings taken relative to the test documented in FIG. 8, using a transport refrigeration system constructed according to the teachings of the invention. Curve 218 indicates the condenser air input temperature or ambient. The ambients are not the same in the graphs of FIGS. 7 and 9 because the tests were started several hours apart. Curve 220 indicates the evaporator air input temperature, curve 222 the evaporator air output temperature, curve 224 the modulation valve voltage, and curve 226 the pilot solenoid voltage.

Comparing curves 194 and 210 it will be noted that the maximum load temperature continued to increase over the test period with the prior art refrigeration unit, starting at 39 degrees F. (3.89 degrees C.) and increasing to about 46 degrees F. (7.78 degrees C.) while the maximum load temperature with the unit constructed according to the teachings of the invention remained at about 39 degrees F. (3.89 degrees C.) throughout the test.

Comparing curves 198 and 212 it will be noted that the average load temperature with the prior art unit varied between 37 and 39 degrees F. (2.78 to 3.89 degrees C.), while with the unit constructed according to the teachings of the invention the average load temperature stayed relatively constant at 36 or 37 degrees F. (2.22 or 2.78 degrees C.).

Comparing curves 196 and 214 it will be noted that the minimum load temperature with the prior art unit varied on both sides of the 34 degrees F. (1.11 degrees C.) set point. The minimum load temperature with the unit constructed according to the teachings of the invention stayed close to but always above the 35 degrees F. (1.67 degrees C.) set point.

Comparing curves 200 and 216 it will be noted that the difference between the maximum and minimum load temperatures increased steadily with the prior art unit, curve 200, starting at about 5 degrees F. (2.77 degrees C.) and increasing to about 11 degrees F. (6.1 degrees C.). On the other hand, the difference with the load conditioned with a unit constructed according to the teachings of the invention, curve 216, was fairly constant at about 4 or 5 degrees F. (2.22 or 2.77 degrees C.).

Comparing curves 204 and 220 it will be noted that the evaporator air input temperature of the prior art unit, curve 204, continuously cycled between about 36 degrees F. (2.22 degrees C.) and 40 or 41 degrees F. (4.44 or 5.0 degrees C.), while the evaporator air input temperature of the unit constructed according to the teachings of the invention, curve 220, stayed relatively flat, varying between about 36 and 38 degrees F. (2.22 and 3.33 degrees C.).

Comparing curves 206 and 222 it will be noted that the evaporator air output temperature swings widely with the prior art unit (curve 206), between about 25 degrees F. (−3.89 degrees C.) and about 37 or 38 degrees F. (2.78 and 3.33 degrees C.), while with the unit constructed according to the teachings of the invention (curve 222), the evaporator air output temperature remains relatively flat, between 33 and 34 degrees F. (0.56 and 1.11 degrees C.).

Comparing curves 208 and 226 it will be noted that the prior art unit cycled continuously between cooling and heating modes, while the unit constructed according to the invention went into the heating mode to hold set point only once, and that was during a low ambient condition.

The modulation valve voltage shown in curve 224 indicates that once the system entered modulation, it remained in modulation.

The fact that system 10 rarely goes into a heating mode, and the small difference between the evaporator input and output air temperatures makes a significant difference in the relative humidity between a load conditioned by a prior art unit and a load conditioned by a unit constructed according to the teachings of the invention. FIGS. 10A, 10B, 10C and 10D compare the relative humidities in trailers with different types of loads, conditioned with a prior art transport refrigeration unit and conditioned with a transport refrigeration unit constructed according to the teachings of the invention, hereinafter referred to as "the modulating unit".

Figure 10A:
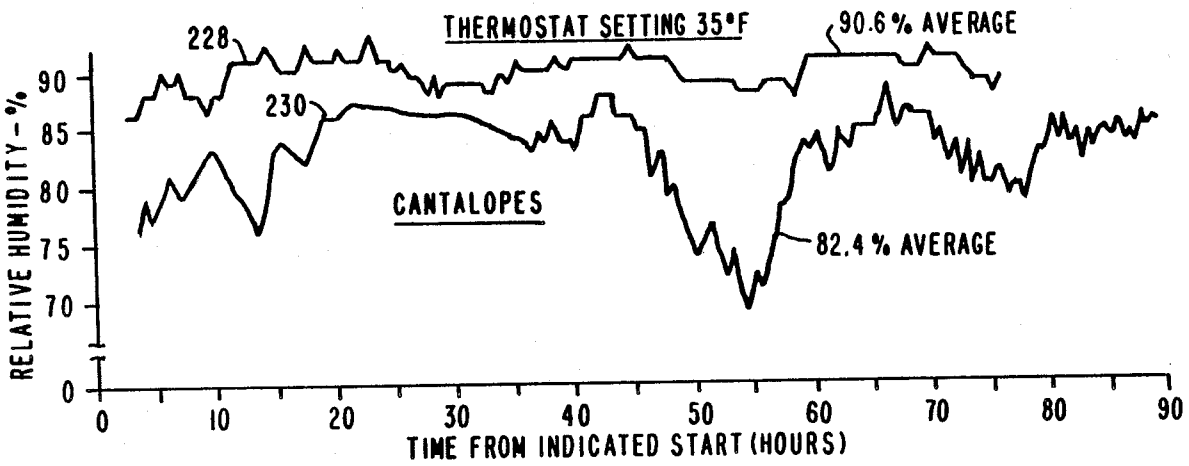
FIGS. 10A–10D are charts comparing the relative humidities in the served space controlled by prior art transport refrigeration systems, and in the served space controlled by transport refrigeration systems constructed according to the teachings of the invention, for different types of fresh produce loads.

Curves 228 and 230 of FIG. 10A compare the relative humidities of loads of cantalope, with a prior art unit, shown in curve 230, averaging 82.4% and the modulating unit, shown in curve 228, averaging 90.6%.

Figure 10B:
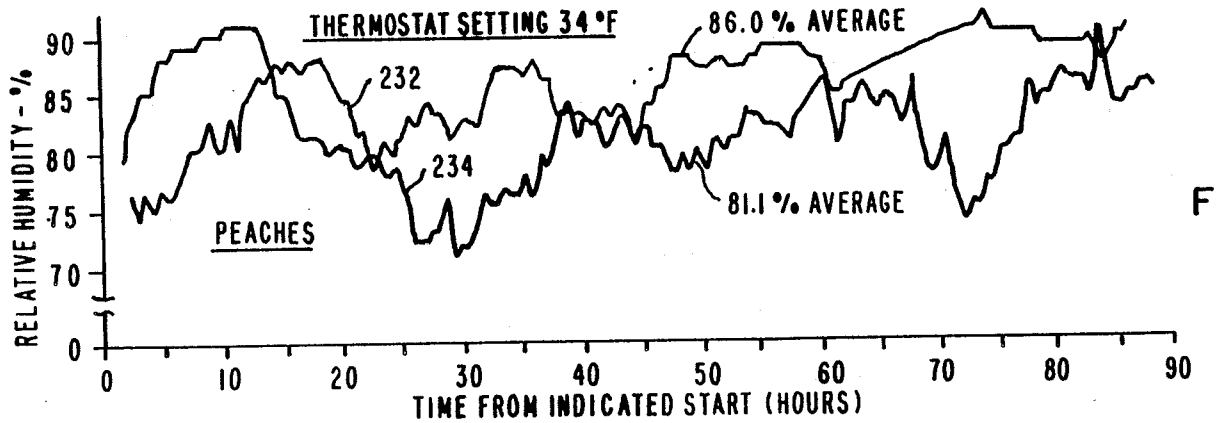

Curves 232 and 234 of FIG. 10B compare the relative humidities of loads of peaches, with a prior art unit, shown in curve 234, averaging 81.1% and the modulating unit, shown in curve 232, averaging 86.0%.

Figure 10C:
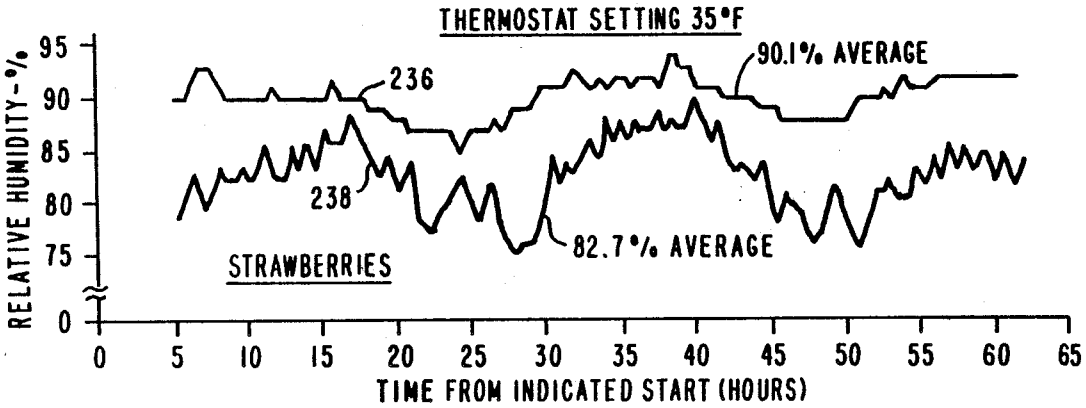

Curves 236 and 238 of FIG. 10C compare the relative humidities of loads of strawberries, with a prior art unit, shown in curve 238, averaging 82.7% and the modulating unit, shown in curve 236, averaging 90.1%.

Figure 10D:
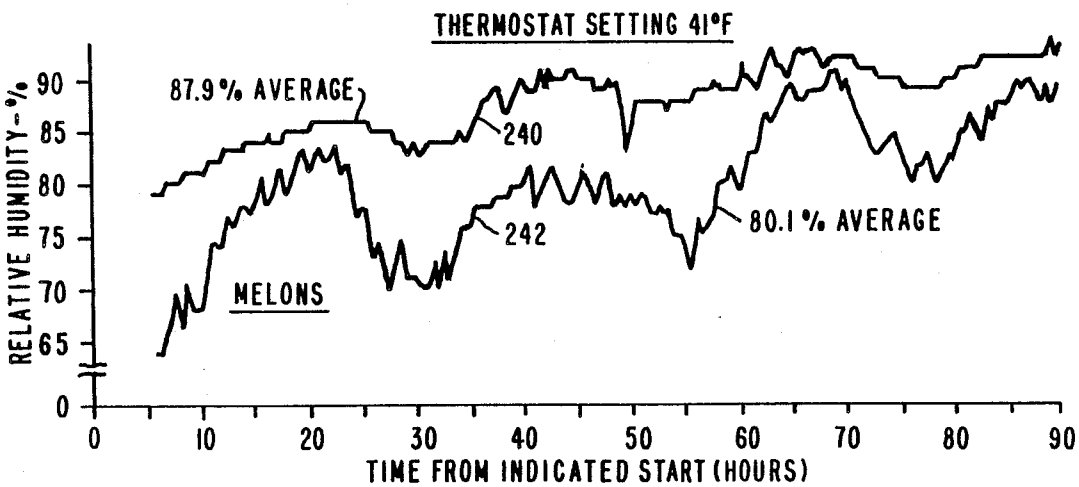

Curves 240 and 242 of FIG. 10D compare the relative humidities of loads of melons, with a prior art unit, shown in curve 242, averaging 80.1% and the modulating unit, shown in curve 240, averaging 87.9%.

We claim:

1. In a transport refrigeration system having a refrigeration circuit including a compressor having discharge and suction ports, a condenser, an evaporator, a liquid line between the condenser and evaporator, expansion means in the liquid line, a suction line between the evaporator and suction port of the compressor, a hot gas line, and valve means disposed to selectively connect the hot gas line from the discharge port of the compressor to either the condenser or the evaporator to initiate cooling and hot gas heating cycles, respectively, and further including air delivery means for the evaporator which draws air from a served space for conditioning by the evaporator, and for returning the conditioned air to the served space, and a prime mover for the compressor, the improvement comprising:

a thermostat having a temperature sensor disposed to sense the temperature of the air returning to the evaporator from the served space, said thermostat providing a digital signal responsive to the difference between the sensed temperature of the air and a desired set point temperature, a modulation valve in the suction line, and modulation control responsive to the digital signal provided by said thermostat for continuously controlling said modulation valve in a predetermined temperature range above and below the desired set point temperature, during both cooling and hot gas heating cycles, whereby the temperature of the served space when containing a load of fresh produce may be maintained close to set point primarily by the cooling cycle, with minimal temperature drop across the evaporator, minimizing moisture removal from the conditioned air and maintaining a high relative humidity in the served space, and the set point may be set close to freezing without danger of damaging the load.

2. In the transport refrigeration system of claim 1, wherein the prime mover for the compressor is a Diesel engine having selectable high and low speeds, and the air delivery means includes means for providing a substantially constant volume of conditioned air regardless of the speed of said Diesel engine.

3. In the transport refrigeration system of claim 1, wherein the modulation valve includes a bleed port, with the modulation control gradually closing the modulation valve during a cooling cycle with a falling sensed temperature, substantially closing the modulation valve when the set point temperature is reached, while the prime mover continues to operate the compressor and provide thermal capacity via the bleed port.

4. In the transport refrigeration system of claim 3 wherein a continued temperature drop below set point temperature initiates a hot gas heating cycle, and the modulation control gradually opens the modulation valve in response to an increasing difference between the sensed temperature and set point temperature.

5. In the transport refrigeration system of claim 4 wherein the modulation control, in response to a rising sensed temperature during a hot gas heating cycle, gradually closes the modulation valve when the sensed temperature is below set point, and gradually opens the modulation valve in response to the sensed temperature continuing to rise above set point.

6. In the transport refrigeration system of claim 1 wherein the refrigeration circuit is devoid of a throttling valve, with the modulation valve performing the function of controlling the pumping capability of the compressor.

7. In the transport refrigeration system of claim 6 including an overload sensor responsive to a predetermined overload condition of the prime mover, with the modulation control controlling the modulation valve in response to the overload sensor when a prime mover overload is detected.

8. In the transport refrigeration system of claim 7 wherein the modulation control operates the modulation valve in the closing direction in response to the overload sensor detecting a predetermined prime mover overload condition.

9. In the transport refrigeration system of claim 1 wherein the modulation valve includes an electric coil, and the modulation control includes a plurality of resistors which are selectively connected to said electric coil in predetermined combinations to control coil current magnitude in response to the value of the digital thermostat signal.

10. In the transport refrigeration system of claim 9 wherein the modulation valve is fully open when the coil current is zero, and including means responsive to predetermined conditions for providing zero current through the electric coil.

11. In the transport refrigeration system of claim 1, an accumulator in the suction line, with the modulation valve being disposed between the evaporator and accumulator to enable the accumulator to protect the compressor against liquid surges through the modulation valve.

12. In the transport refrigeration system of claim 1, a heat exchanger and an accumulator in the suction line, with the modulation valve being disposed in the suction line immediately adjacent to the evaporator, whereby the heat exchanger and accumulator protect the compressor against liquid surges through the modulation valve.

* * * * *